US005899778A

United States Patent [19]

Hiraoka et al.

[11] Patent Number: 5,899,778

[45] Date of Patent: May 4, 1999

[54] OUTBOARD MOTOR INDUCTION SYSTEM

[75] Inventors: Noriyoshi Hiraoka; Masanori Takahashi; Hitoshi Watanabe, all of Hamamatsu, Japan

[73] Assignee: Sanshin Kogyo Kabushiki Kaisha, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/837,274

[22] Filed: Apr. 11, 1997

[30] Foreign Application Priority Data

Apr. 12, 1996 [JP] Japan ..... 8-114374

[51] Int. Cl.[6] ..... B63H 21/10

[52] U.S. Cl. ..... 440/88; 440/77; 440/900; 123/195 P; 123/184.21

[58] Field of Search ..... 440/77, 78, 88, 440/89, 900; 123/184.21, 195 P

[56] References Cited

U.S. PATENT DOCUMENTS

| | | | |
|---|---|---|---|
| 4,126,115 | 11/1978 | List et al. | 123/198 E |
| 4,522,602 | 6/1985 | Okazaki | 440/77 |
| 4,533,331 | 8/1985 | Bland | 440/88 |
| 4,721,485 | 1/1988 | Suzuki | 440/77 |
| 4,878,467 | 11/1989 | Schmidt | 123/195 C |
| 4,960,081 | 10/1990 | Atsuumi | 123/195 C |
| 4,967,704 | 11/1990 | Imaeda | 123/52 MV |
| 4,978,321 | 12/1990 | Ferguson | 440/88 |
| 5,049,100 | 9/1991 | Yamamoto et al. | 440/77 |
| 5,328,395 | 7/1994 | Oishi | 440/77 |
| 5,340,343 | 8/1994 | Kawamukai et al. | 440/88 |
| 5,445,547 | 8/1995 | Furukawa | 440/77 |
| 5,488,939 | 2/1996 | Nakai et al. | 123/572 |

FOREIGN PATENT DOCUMENTS

| | | | |
|---|---|---|---|
| 100093 | 6/1984 | Japan | 440/88 |
| 2-212295 | 8/1990 | Japan . | |
| 4-166496 | 6/1992 | Japan . | |
| 6-16187 | 1/1994 | Japan . | |
| 6016187 | 1/1994 | Japan | 440/88 |

*Primary Examiner*—Jesus D. Sotelo

*Attorney, Agent, or Firm*—Knobbe, Martens, Olson & Bear, LLP

[57] ABSTRACT

An induction system for an outboard motor of the type having a water propulsion device powered by an internal combustion engine positioned within an engine compartment defined by a cowling, is disclosed. The induction system includes a cover extending over a top end of the engine. The cover defines an air duct leading from an intake chamber defined by the cowling to an intake pipe of the air intake system of the engine. The cover also defines an air duct in communication with the engine compartment and leading to an exhaust chamber defined by the cowling. A pair of intake ports lead through a cover of the cowling from the intake chamber, and an exhaust port leads through the cover from the exhaust chamber. The intake ports are positioned forward of the exhaust port when considering the forward movement of a watercraft which is powered by the motor.

17 Claims, 9 Drawing Sheets

OUTBOARD MOTOR INDUCTION SYSTEM

FIELD OF THE INVENTION

The present invention relates to an outboard motor powered by an internal combustion engine. More particularly, the invention is an induction system for the motor for providing air to the engine and for venting air from the motor.

BACKGROUND OF THE INVENTION

Outboard motors are often powered by internal combustion engines. The engine is typically positioned within an enclosed cowling. The engine is generally vertically arranged, so that a crankshaft thereof may extend downwardly in driving relation with a water propulsion device of the motor, such as a propeller. In order to balance the motor and because of space considerations, the engine is arranged with a crankcase of the engine facing in the direction of a watercraft to which the motor is mounted, and with the cylinder head and intake system positioned on an end of the engine facing away from the watercraft.

Air must be supplied to the engine through the cowling for combustion. An air vent is provided in the cowling. Due to the orientation of the engine, a surge tank of the engine's intake system is positioned on the end of the engine facing the watercraft.

In order to prevent the direct entry of water through the vent into the intake system, the vent must be positioned away from the intake system. Thus, the vent is typically positioned in the portion of the cowling above the cylinder head of the engine (i.e., above the end of the engine opposite the surge tank). Air is drawn through the vent along the top of the engine to its front end and into the intake system.

A problem arises in that air within the cowling is heated by the engine and rises upwardly and mixes with the incoming fresh air. The engine thus draws a mixture of fresh and heated engine air, resulting in poor engine performance.

A cowling arrangement for an outboard motor which permits the engine therein to draw fresh air and which is arranged to reduce the introduction of water into the engine through the induction system, is desired.

SUMMARY OF THE INVENTION

An induction system for an outboard motor of the type having a cowling defining an engine compartment and having an internal combustion engine mounted therein, is disclosed. The engine has a top end and a bottom end and a crankshaft which is vertically extending and arranged in driving relation with a drive shaft of the motor which drives a water propulsion device.

The engine has an intake or induction system which includes an air pipe leading to at least one surge tank. Runners extend from the surge tank to passages through an intake manifold leading to passages through the engine leading to the combustion chambers thereof.

The induction system of the present invention preferably includes a cover extending over the top of the engine within the engine compartment. The cover defines an intake duct extending generally across the top end of the engine. The duct has an inlet and an outlet, the outlet positioned at the inlet of the air pipe of the engine's intake system.

The cover also defines an exhaust duct. This duct has an inlet in communication with the area of the engine compartment surrounding the engine and positioned below the cover. The duct leads to an exhaust outlet.

Most preferably, the cowling includes a recessed area and cooperates with a cover to define an intake chamber and exhaust chamber. An intake port is positioned in the cover on each side of the motor, and a single exhaust port is positioned in the cover at the rear of the motor, generally downstream of the intake ports.

The inlet of the intake duct leads to the intake chamber of the cowling, and the outlet of the exhaust duct leads to the exhaust chamber. Preferably, the inlet of the intake duct is positioned within an upstanding flange, as is the outlet of the exhaust duct, preventing water which enters the chambers from flowing through the ducts in the direction of the engine.

In use, air flows through the intake ports in the cowling into the intake chamber. The air then flows through the inlet of the intake duct and through the duct across the top of the engine to the intake pipe of the engine's intake system. Heated air within the engine compartment is drawn into the exhaust duct and expelled through the outlet thereof into the exhaust chamber. The exhausted air then flows from the exhaust chamber in the cowling through the exhaust port to a point exterior of the motor.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
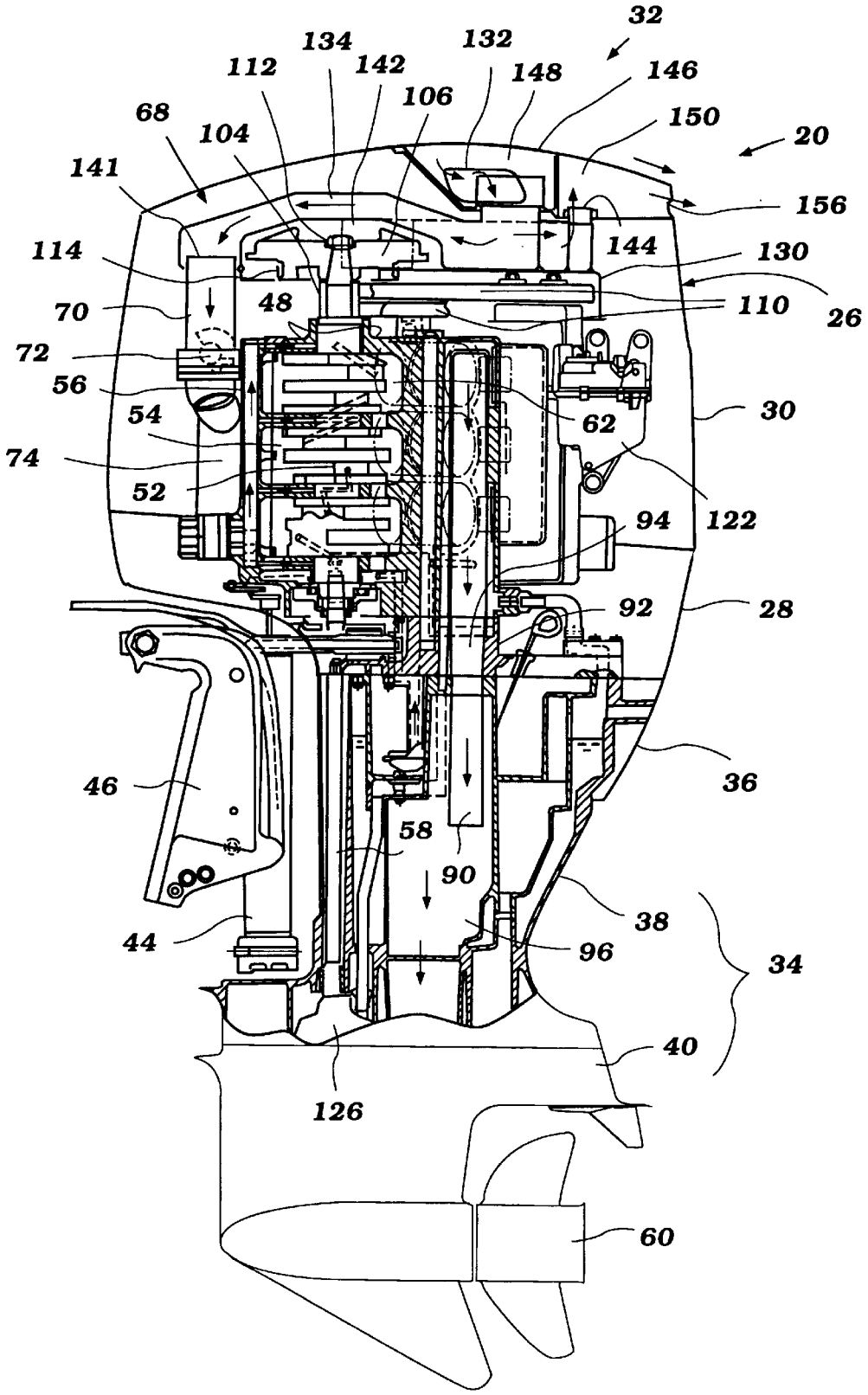
FIG. 1 is a partial cross-sectional view of an outboard motor powered by an internal combustion engine and having an induction system in accordance with the present invention.

In accordance with the present invention, there is provided an improved induction system for an outboard motor powered by an internal combustion engine.

The outboard motor 20 is of the type utilized to power a watercraft. The outboard motor 20 has a powerhead area 26 comprised of a lower tray portion 28 and a main cowling portion 30. An air inlet and vent area 32 is provided in the main cowling portion 30 for providing air to an engine therein, as described in more detail below. The motor 20 includes a lower unit 34 extending downwardly therefrom, with an apron 36 providing a transition between the powerhead 26 and the lower unit 34. The lower unit 34 comprises an upper or "drive shaft housing" section 38 and a lower section 40.

A steering shaft, not shown, is affixed to the lower section 40 of the lower unit 34 by means of a bracket 42. The steering shaft is supported for steering movement about a vertically extending axis within a swivel bracket 44. The swivel bracket 44 is connected by means of a pivot pin to a clamping bracket 46 which is attached to a transom portion of a hull of the watercraft. As is well known, the pivot pin permits the outboard motor 20 to be trimmed and tilted up about the horizontally disposed axis formed by the pivot pin.

Figure 2:
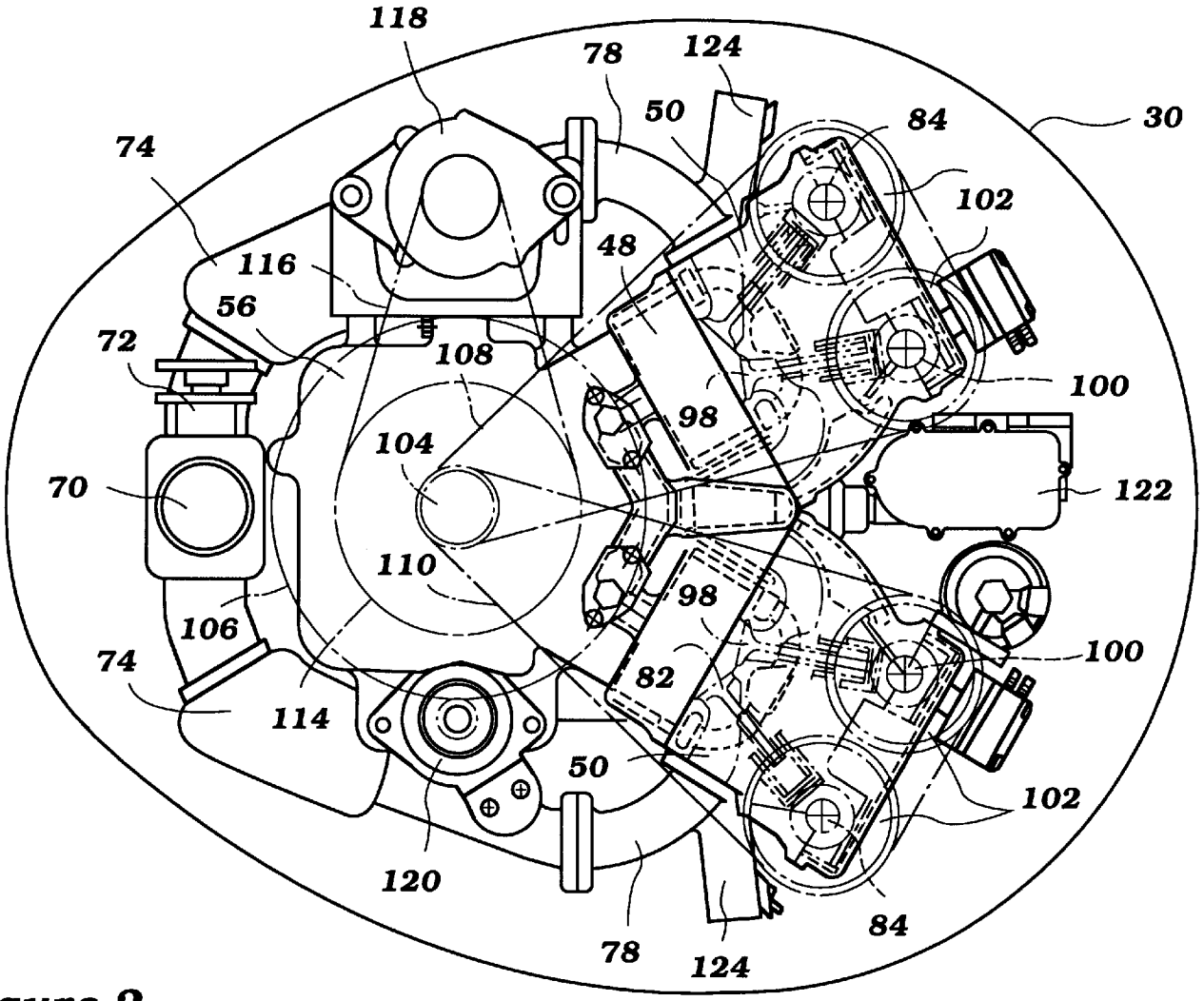
FIG. 2 is a cross-sectional view of the outboard motor illustrated in FIG. 1 exposing a top end of the engine.
Figure 3:
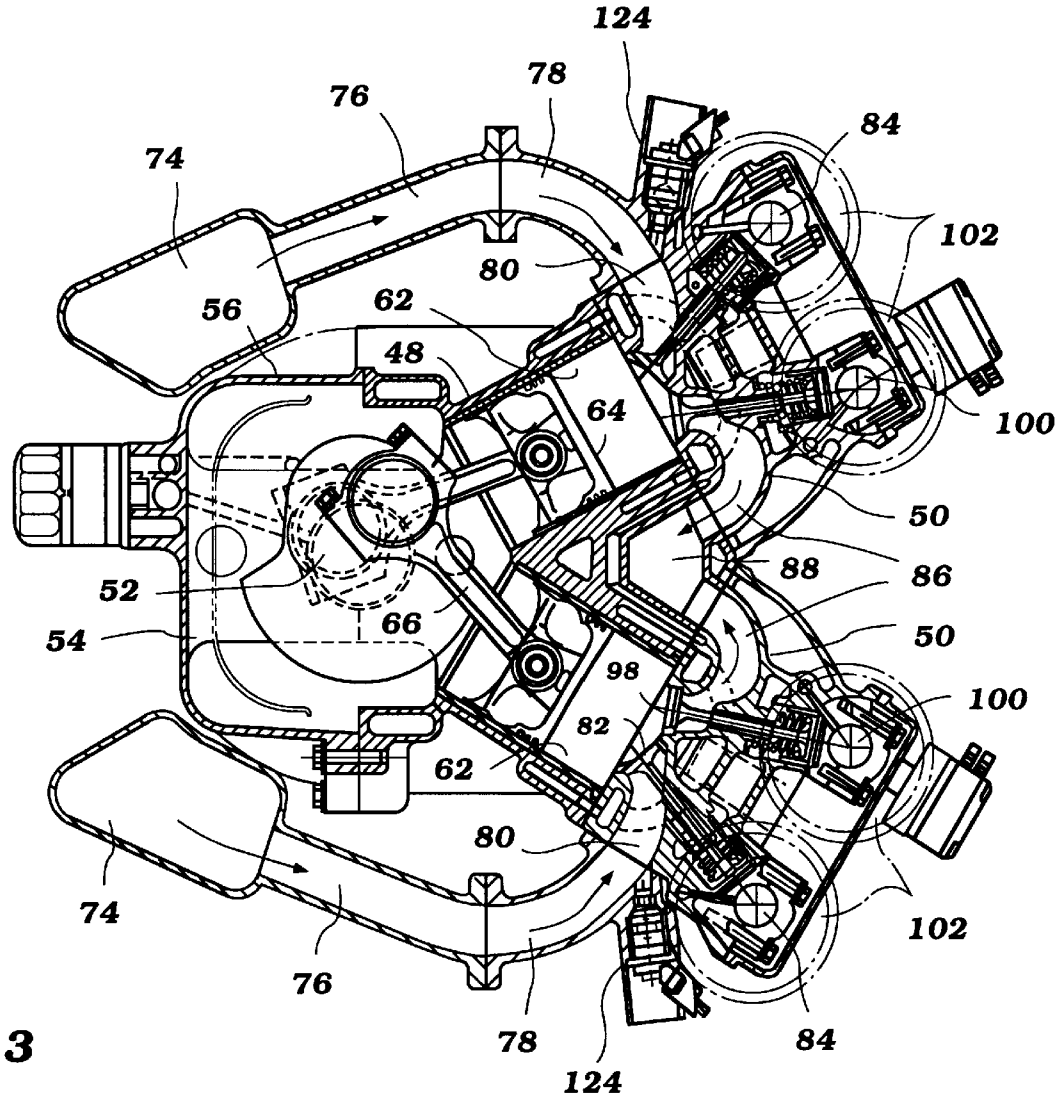
FIG. 3 is a cross-sectional view of the engine illustrated in FIG. 2.

As illustrated in FIGS. 1–3, the power head 26 of the outboard motor 20 includes the engine 22 which is positioned within the cowling portion 30. The engine 22 is preferably of the four-cylinder variety, arranged in "V" fashion, and includes a cylinder block 48 with a pair of cylinder banks closed by a pair of cylinder head assemblies 50 in a manner which will be described. As also illustrated in FIG. 2, the engine 22 is preferably oriented within the cowling 30 such that the cylinder heads 50 are positioned on the block 48 on the side opposite the watercraft's transom.

A crankshaft 52 is rotatably journalled in a crankcase chamber 54 formed by the cylinder block 48 a crankcase cover 56. As is typical with outboard motor practice, the engine 22 is mounted in the power head 26 so that the crankshaft 52 rotates about a vertically extending axis. This facilitates coupling to a drive shaft 58 in a manner which will be described.

The drive shaft 58 depends into the lower unit 34, wherein it drives a conventional bevel gear and a forward-neutral-reverse transmission. The transmission is not illustrated herein, because its construction per se forms no part of the invention. Therefore, any known type of transmission may be employed.

The transmission drives a propeller shaft which is journalled within the lower section 40 of the lower unit 34 in a known manner. A hub of a propeller 60 is coupled to the propeller shaft for providing a propulsive force to the watercraft 24 in a manner well known in this art.

Referring again to FIGS. 2–4, the engine 22 preferably has six combustion chambers 62. The engine 22 may have a greater or lesser number of combustion chambers, such as two, four, or eight or more. In this arrangement, the block 48 cooperates with each cylinder head 50 to define three combustion chambers within each bank.

A piston 64 is movably positioned in each combustion chamber 62. Each piston 64 is connected to a connecting rod 66 extending to a vertically extending crankshaft 52. The crankshaft 52 is arranged in driving relation with the drive shaft 58.

The engine 22 includes an air intake system 68 for providing air to each combustion chamber 62. That portion of the intake system 68 corresponding directly to the engine is described herein, with the portion of the intake system through which air is routed through the cowling 30 of the motor 20 to the engine intake, described in detail below.

As illustrated in FIGS. 1–3, air is directed into an intake pipe 70 having a throttle valve 72 positioned therein for controlling the flow rate of air through the pipe. The air intake pipe 70 extends along the end of the engine 22 which faces in the direction of the watercraft when the motor 20 is mounted thereto.

Air passes through the pipe 70 to a pair of branch pipes leading to a pair of surge tanks 74. As best illustrated in FIG. 2, the surge tanks 74 are generally positioned at either side of the end of the crankcase cover 56. Each surge tank 74 corresponds to one of the cylinder banks.

Figure 7:
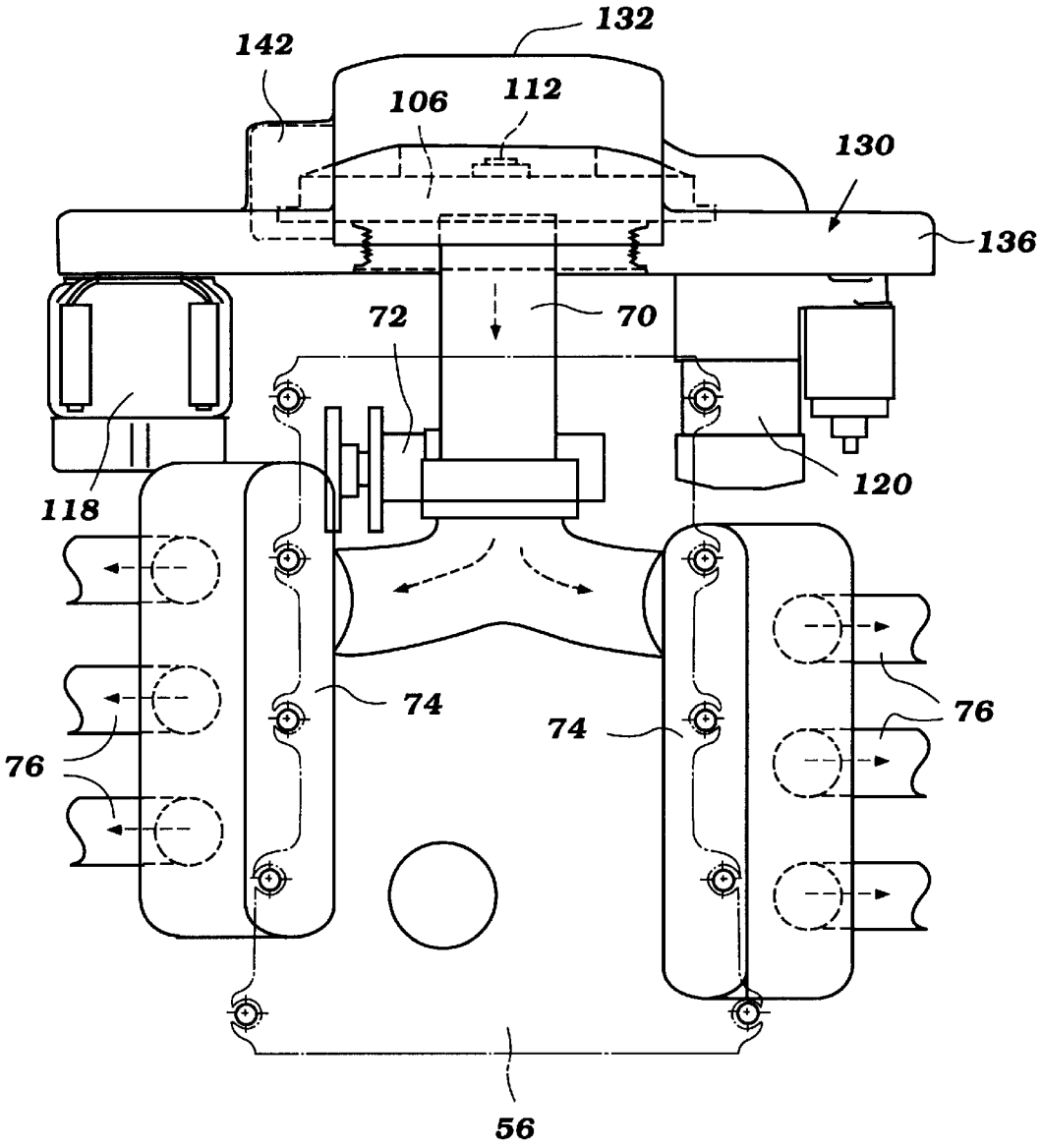
FIG. 7 is a view of the engine and cover taken along line 7—7 in FIG. 5.

Runners 76 extend from each surge tank 74 to an intake manifold 78. Preferably, the number of runners 76 extending from each surge tank 74 equals the number of combustion chambers 62 in one of the cylinder banks. Thus, in the present embodiment and as illustrated in FIG. 7, there are preferably three runners 76 extending from each surge tank 74.

Each runner 76 has a passage therethrough leading to a corresponding passage in the intake manifold 78. As best illustrated in FIG. 3, each intake manifold 78 is mounted to its respective cylinder head 50 at an outer side thereof. Each passage through the intake manifold 78 aligns with a corresponding intake passage 80 leading through the cylinder head 50 to one of the combustion chambers 62.

As best illustrated in FIG. 3, means are provided for regulating the flow of air into each combustion chamber 62. Preferably, this means comprises an intake valve 82 corresponding to each intake passage 80. As illustrated, all of the intake valves 82 for each bank of cylinders are preferably actuated by a single intake camshaft 84. Each intake camshaft 84 is mounted for rotation with respect to its respective head 50 and connected thereto with a bracket. The camshafts 84 are enclosed by a camshaft cover which is connected to the respective head 50.

An exhaust system is provided for routing the products of combustion within the combustion chambers 62 to a point external to the engine 22. In particular, an exhaust passage 86 leads from each combustion chamber to a common exhaust passage 88 extending through the "V" portion of the cylinder block 48 between the cylinder banks.

As best illustrated in FIG. 1, the exhaust flowing through the common exhaust passage 88 flows through an exhaust passage 94 in an exhaust guide 92 positioned at the bottom of the engine 22. The passage 94 through the exhaust guide leads to an exhaust pipe 90 extending downwardly into an exhaust chamber or muffler 96 positioned in the lower unit 34 of the outboard motor 20. An outlet, such as in the hub of the propeller 60, is in communication with the chamber 96 for expelling exhaust gases from the motor 20 to a point exterior thereof, as is well known in the art.

Referring again to FIG. 3, means are also provided for controlling the flow of exhaust from each combustion chamber 62 to its respective exhaust passage 86. Preferably, this means comprises an exhaust valve 98. Like the intake valves 82, the exhaust valves 98 of each cylinder bank are preferably all actuated by a single exhaust camshaft 100. Each exhaust camshaft 100 is journalled for rotation with respect to its respective cylinder head 50 and connected thereto with a bracket. The exhaust camshaft 100 is enclosed within the camshaft cover which also covers the intake camshaft 82 of that bank.

As best illustrated in FIG. 2, means are provided for driving the camshafts 82,100. A timing belt pulley 104 is mounted on a top end of the crankshaft 52 positioned outside of the cylinder block 48, and just below a flywheel 106 also positioned on the crankshaft 52. A camshaft pulley 102 is mounted on an end of each camshaft 82,100 extending from the top end of the engine 22. A first drive belt 108 extends around the timing belt pulley 104 and the pulleys 102 corresponding to a first cylinder bank, and a second drive belt 110 extends around the timing belt pulley 104 and the camshaft pulleys 102 of the other cylinder bank. By this arrangement, the camshaft 52 indirectly drives the two intake and two exhaust camshafts 82,100. One or more tensioner pulleys (not shown) may be provided for maintaining the belt in a taunt condition.

Figure 5:
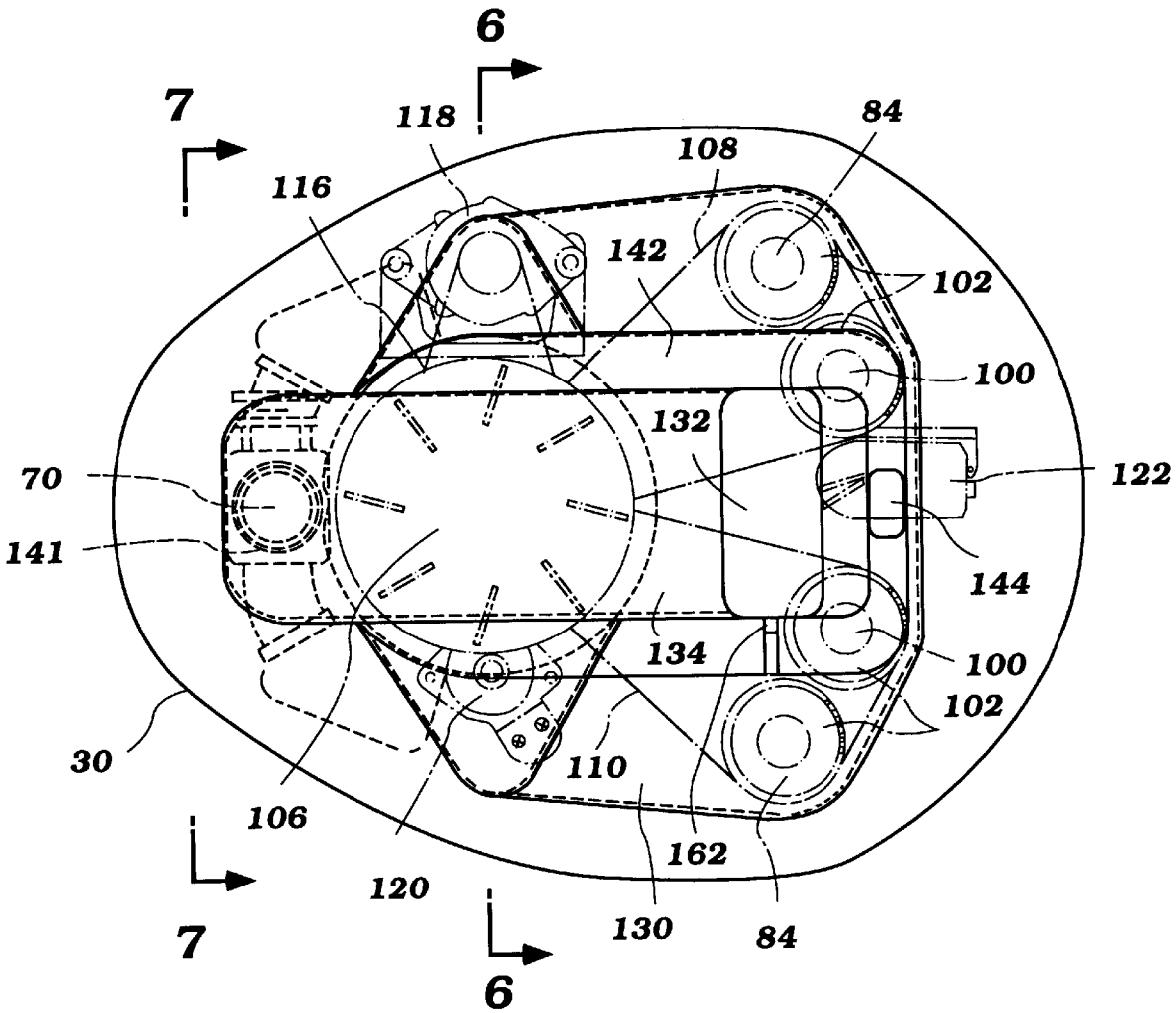
FIG. 5 is a cross-sectional top view of the outboard motor illustrated in FIG. 1, exposing the cover mounted at an end of the engine, illustrated in phantom.
Figure 6:
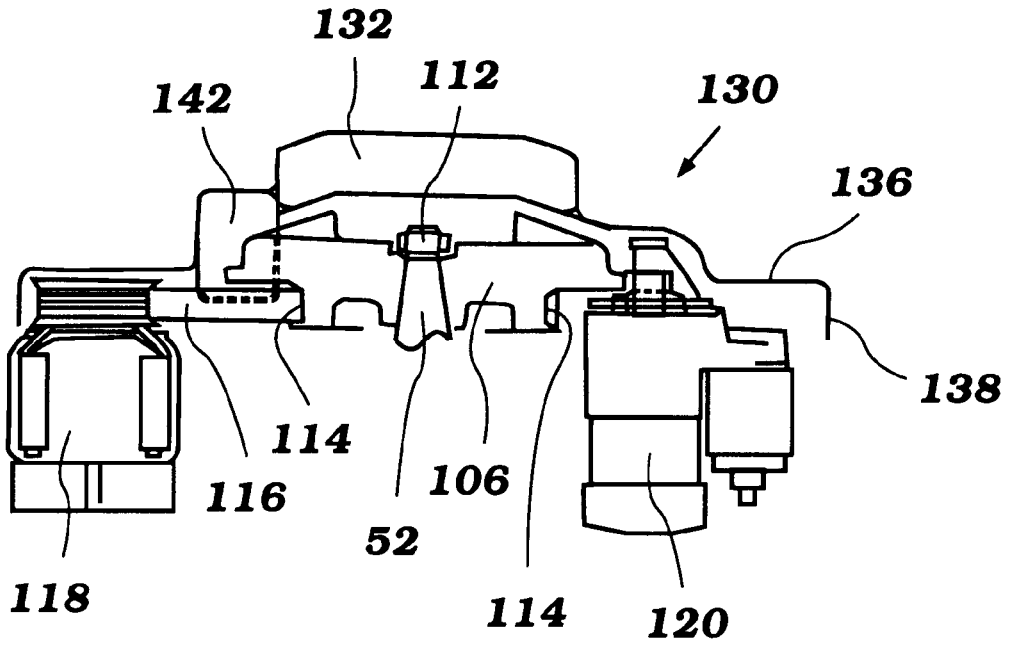
FIG. 6 illustrates portions of the top end of the engine with the cover of the induction system illustrated in cross-section along line 6—6 in FIG. 5.

As illustrated in FIG. 3, the flywheel 106 is preferably maintained in position on a tapered end of the crankshaft 52 with a nut 112. As illustrated in FIGS. 2, 5 and 6, the flywheel 106 also includes a pulley portion 114 for driving an alternator drive belt 116. The alternator drive belt 116 extends to a pulley of an alternator 118 positioned along the side of the engine 22 at the top of the engine.

A starter 120 is preferably positioned on the side of the engine 22 opposite the alternator 118 and also at the top of the engine. The starter 120 is arranged to selectively engage the flywheel 106 for use in starting the engine 22, as is well known in the art.

A fuel delivery system is provided for delivering fuel to each combustion chamber 62 for combustion therein. The fuel delivery system preferably includes a fuel tank (not shown) and a fuel pump (not shown) for pumping fuel from the tank and delivering it to each combustion chamber 62. A vapor separator 122 (see FIGS. 1 and 2) may be included in the fuel system, and preferably, the fuel is injected into the air stream flowing through each passage of each intake manifold 78 with a fuel injector 124.

A suitable ignition system is provided for igniting an air and fuel mixture within each combustion chamber 62. Such systems are well known to those skilled in the art, and as such forms no portion of the invention herein, such is not described in detail here.

The engine 22 includes a lubricating system for providing lubricant to the various portions of the engine. The lubricating system is not described in detail here, and may be of any type found suitable to those skilled in the art.

A cooling system is also provided for cooling the engine 22. The cooling system may be arranged in any manner found suitable to those skilled in the art. As is known, the cooling system typically includes a pump 126 (see FIG. 1) for pumping cooling water from the body of water in which the motor 20 is operating. The pump 126 delivers the cooling water through one or more cooling water passages or jackets in the cylinder heads and block 48, and commonly through one or more exhaust system cooling jackets.

In accordance with the present invention, an outboard motor induction system is provided for providing air to the intake system of the engine, and for routing heated air from the area within the motor surrounding the engine 22. The induction system comprises a cover 130 extending over the top end of the engine 22 within the cowling 30. The cover 130 is adapted to cooperate with the cowling 30 to route fresh air from outside the cowling through the cowling and to the intake pipe 70 of the induction system of the engine 22. At the same time, the cover 130 is adapted to route heated air surrounding the engine 22 through the cowling 30 to a point outside of the cowling 30.

Figure 9:
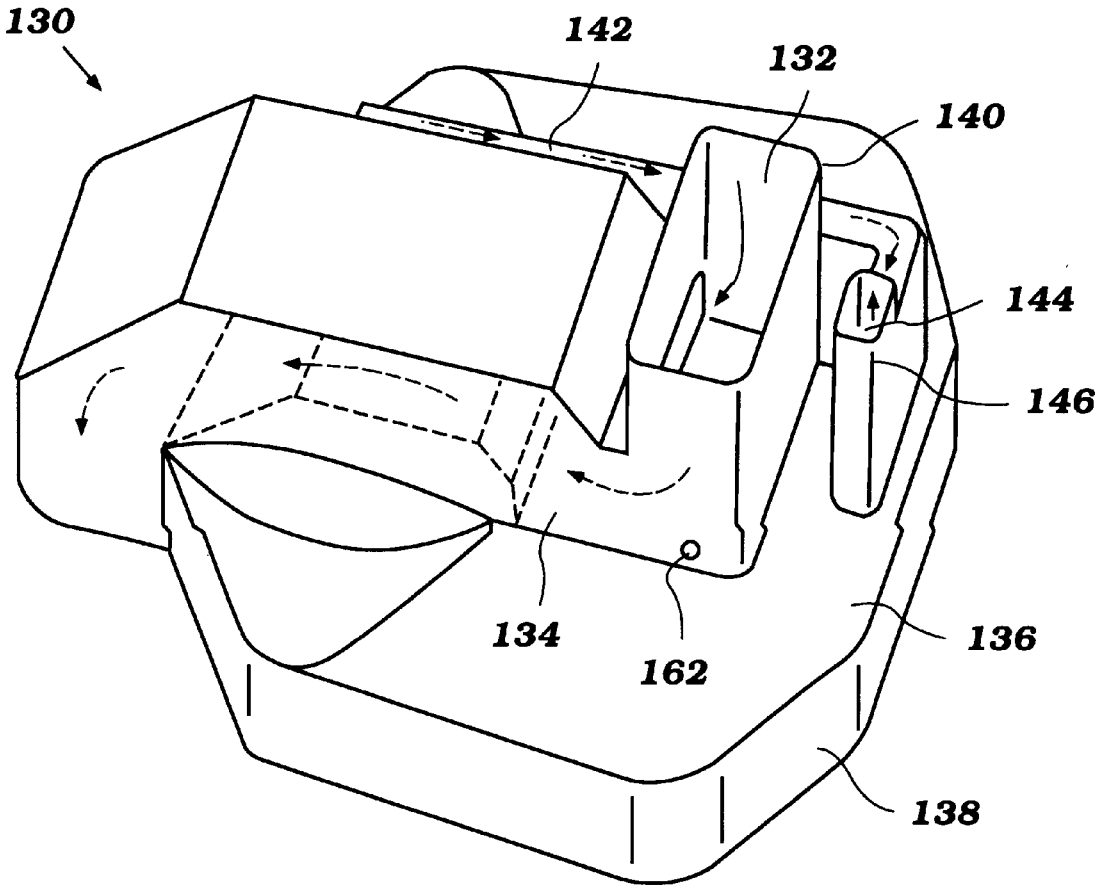
FIG. 9 is a top perspective view of the engine cover of the induction system of the present invention.

Referring to FIGS. 6, 7 and 9, the cover 130 has a base section 136 which extends over the top end of the engine 22, including the alternator 118 and starter 120. The base section 136 has a downwardly extending peripheral skirt 138.

As illustrated in FIG. 9, an intake air duct 134 extends across the top of the base section 136 of the cover 130. The intake duct 134 has a fresh air inlet 132 at one end, the inlet 132 defined by an upstanding flange 140. The intake duct 134 has an outlet 141 at the its other end, the outlet 141 positioned at the inlet of the intake pipe 70 of the induction system of the engine 22.

An exhaust duct 142 also extends across the top of the base section 136 of the cover 130, generally adjacent the intake duct 134. The exhaust duct 142 has an inlet or opening through the base section 136 of the cover, and extends to an outlet 144 through an upstanding flange portion 146 of the duct 142.

Figure 4:
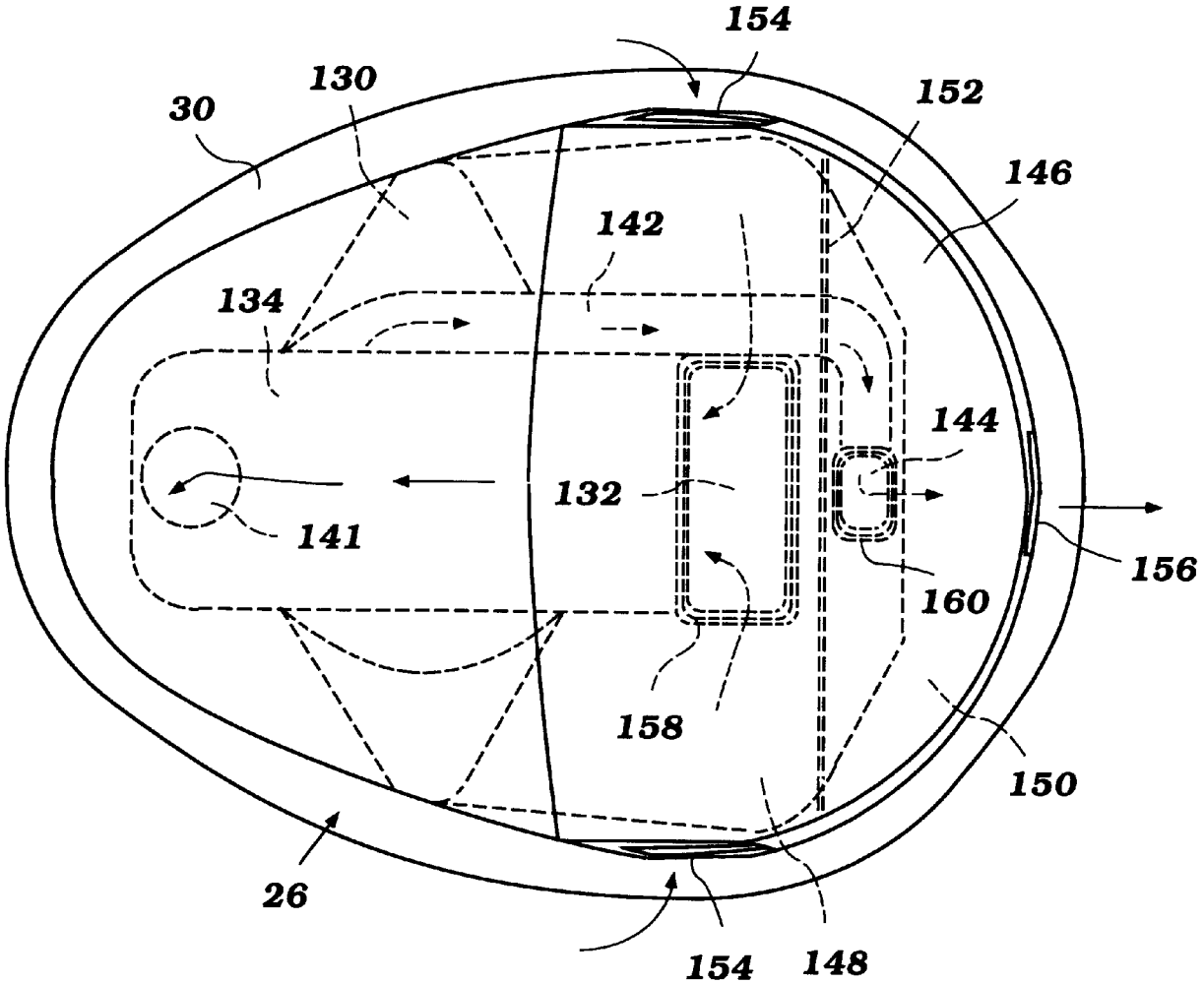
FIG. 4 is a top view of the outboard motor illustrated in FIG. 1, with an engine cover of the induction system illustrated in phantom.
Figure 8:
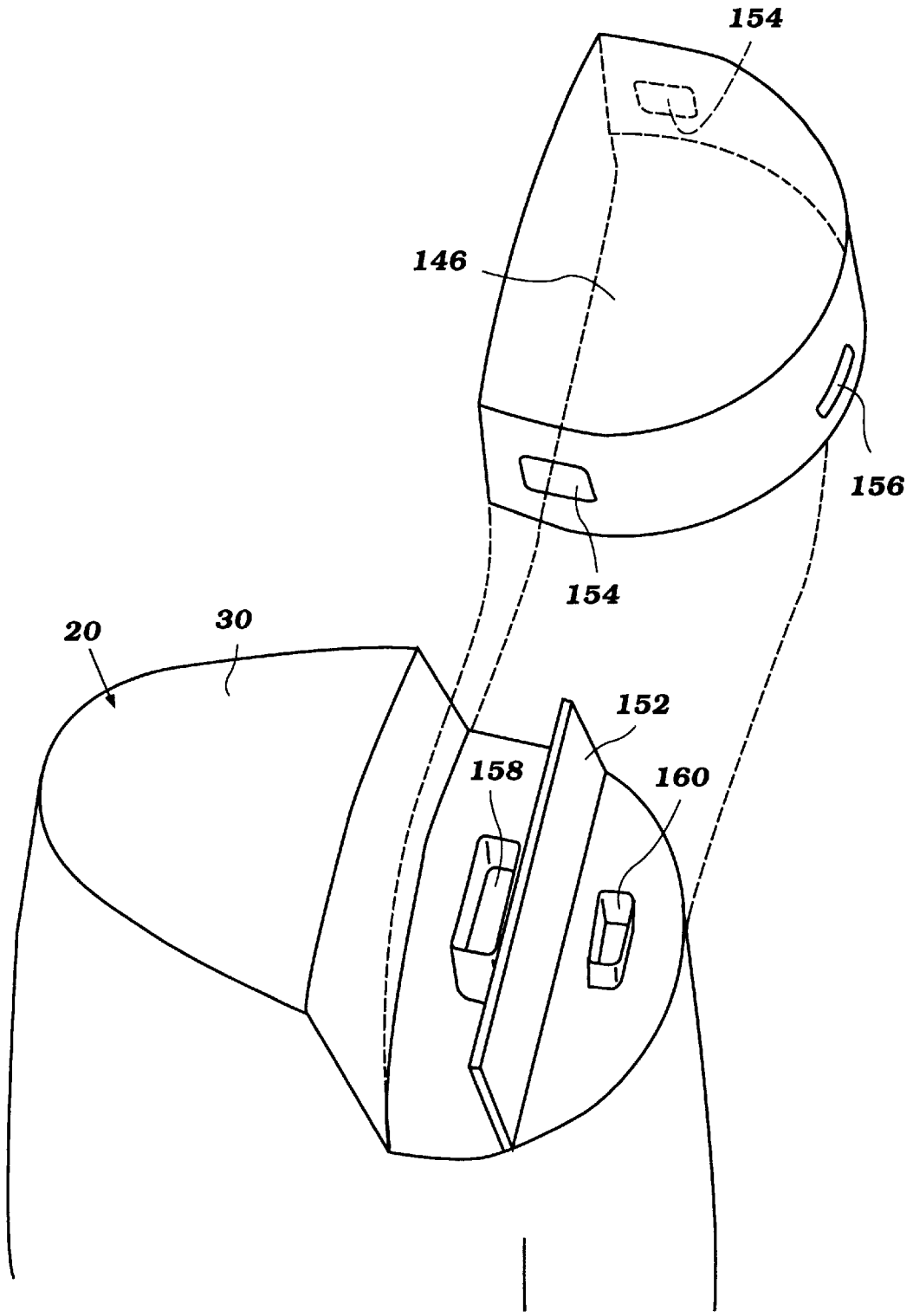
FIG. 8 is a perspective view of the cowling and a combined induction and vent cover of the outboard motor illustrated in exploded view.

As best illustrated in FIGS. 1, 4 and 8, the cover 130 cooperates with the cowling 30. As set forth above, the cowling 30 includes a vent portion 32. This portion 32 comprises a cover 146 which cooperates with the remainder of the cowling 32 to define an intake chamber 148 and an exhaust chamber 150. In particular, the cowling 30 has a recessed area therein on the side opposite the watercraft when the motor 20 connected thereto. The recessed area has a dividing wall 152 extending across it. When the cover 146 is installed, it extends over the recessed portion of the cowling 30 and engages the wall 152, thereby forming the intake and exhaust chambers 148,150.

As illustrated, an intake port 154 is provided through either side of the cover 146 at that portion corresponding to the intake chamber 148. Most preferably, the ports 154 are provided opposite one another in the widest portion of the engine cowling 30. Likewise, a single exhaust port 156 is provided in a rear portion of the cover 146 corresponding to the exhaust chamber 150.

An intake opening 158 is provided in the cowling 30. The opening 158 is preferably formed in an upwardly extending flange adapted to receive the upwardly extending flange portion 140 of the intake duct 134. Likewise, an exhaust opening 160 is provided in the cowling 30. The opening 160 is formed in an upwardly extending flange adapted to receive the upwardly extending flange portion 146 of the exhaust duct 142.

Referring to FIGS. 4–9, the engine 22 draws air through the side ports 154 in the cover 146 portion of the cowling 30. This air enters the intake chamber 148. The air is then drawn through the intake opening 158 in the cowling 30 through the inlet 132 of the intake duct 134. The air flows through the duct 134 to the outlet 141, and into the intake pipe 70 of the induction system of the engine 22 to the combustion chambers 62, in the manner described above.

In addition, heated air which surrounds the engine 22 within the cowling 30 is drawn from under the cover 130 through the base 136 into the exhaust duct 142. The heated air flows through the exhaust duct 142 to the duct outlet 144 and the opening 160 in the cowling 30 into the exhaust chamber 150. The exhausted air is then expelled through the exhaust port 156 in the cowling 30 at the rear of the outboard motor 30 opposite the watercraft.

A water drain 162 may be provided through the wall of the cover 130 defining the intake duct 134 for allowing water which enters the duct 134 from being transmitted to the engine 22. As illustrated in FIG. 2, this drain 162 is preferably positioned in the duct 134 below the upstanding flange portion 140 defining the inlet 132. A similar drain may be provided for the exhaust duct 142, if desired.

The induction system of the present invention has numerous advantages over the prior art. First, air which is provided through the cowling is not mixed with heated air in surrounding the engine and then drawn into the engine. Thus, the incoming air remains cooler, providing greater engine performance and efficiency.

In addition, heated air is expelled from the area surrounding the engine. Cooler air is drawn into the cowling to replace the heated air, whereby the engine is cooled.

The induction system provides for the directed flow of air from the inlet port through the cowling to the engine, but is arranged to prevent water from entering the engine. First, the upstanding flange of the intake opening in the intake chamber in the cowling reduces the possibility of water entering the engine. In addition, that water which is drawn into the intake duct is allowed to drain therefrom through the drain instead of being drawn therealong to the engine.

The position of the intake ports in relation to the exhaust port, and the position of these ports relative the cowling is also advantageous. First, the intake ports are positioned in front of the exhaust port when considering the forward motion of the watercraft. This prevents heated air exhausted through the exhaust port from entering the intake ports. In addition, since the exhaust port is at the rear of the motor, the low pressure area created at this end of the motor when the watercraft is moving aids in drawing the heated air from the area surrounding the motor.

The cover 130 is useful as a safety feature as well. In those instances where the operator may open the cowling to access the engine 22, the cover 130 serves to protect the operator from engaging a hot portion of the engine and burning himself, and from encountering the moving belts 108,110, 116.

Of course, the foregoing description is that of preferred embodiments of the invention, and various changes and modifications may be made without departing from the spirit and scope of the invention, as defined by the appended claims.

What is claimed is:

1. An outboard motor having a cowling with an internal combustion engine positioned therein, said motor having a front end and a rear end and opposing sides between said ends, said engine having a top end and a bottom end and a generally vertically oriented crankshaft, said crankshaft extending below said engine in driving relation with a water propulsion device of said motor, said motor having an induction system for routing air therethrough to an intake of said engine, said induction system including a cover positioned between said cowling and said top end of said engine, said cover defining an isolated air intake flow path from an intake opening in said cowling to said air intake of said engine, and defining an air exhaust path leading from a space surrounding said engine to an exhaust opening in said cowling.

2. The outboard motor in accordance with claim 1, wherein said cowling defines an intake chamber and an exhaust chamber, and wherein said intake opening leads from said intake chamber and said exhaust opening leads to said exhaust chamber.

3. The outboard motor in accordance with claim 2, wherein at least one intake port is provided through a wall of said cowling to said intake chamber.

4. The outboard motor in accordance with claim 2, wherein at least one exhaust port is provided through a wall of said cowling to said exhaust chamber.

5. The outboard motor in accordance with claim 2, wherein at least one intake port is provided through a wall of said cowling to said intake chamber and at least one exhaust port is provided in said wall to said exhaust chamber, and wherein said at least one intake port is positioned nearer said front end of said motor than said exhaust port.

6. The outboard motor in accordance with claim 4, wherein said at least one exhaust port is positioned in said cowling at said rear end thereof.

7. The outboard motor in accordance with claim 2, wherein said intake and exhaust chambers are defined by a cowling cover cooperating with a recessed section of said cowling.

8. The outboard motor in accordance with claim 1, wherein said isolated air intake flow path comprises a duct of said cover.

9. The outboard motor in accordance with claim 1, wherein said air exhaust path comprises a duct of said cover.

10. The outboard motor in accordance with claim 1, wherein said intake opening is in communication with a pair of intake ports through said cowling, said ports positioned on opposite sides of said cowling at a widest portion thereof.

11. The outboard motor in accordance with claim 1, wherein said air intake of said engine comprises an air intake pipe leading to at least one surge tank of said engine.

12. The outboard motor in accordance with claim 1, wherein a flywheel, starter motor and alternator are positioned at said top end of said engine and positioned under said cover.

13. The outboard motor in accordance with claim 1, wherein said engine has a camshaft drive at said top end thereof and said cover extends over said camshaft drive.

14. An outboard motor comprising a cowling defining an engine compartment, said cowling having a front end and a rear end, said motor including a water propulsion device and an internal combustion engine, said engine positioned within said engine compartment and having a top end and a bottom end and a vertically extending crankshaft in driving relation with said water propulsion device, said engine having an air intake having an inlet, said outboard motor including an induction system, said system including a cover extending over substantially said top end of said engine, said cover defining a first isolated air flow path from at least one intake port through said cowling to said inlet of said air intake of said engine and a second air flow path from said engine compartment to at least one exhaust port through said cowling, said at least one intake port positioned forward of said at least one exhaust port.

15. The outboard motor in accordance with claim 14, wherein said at least one exhaust port is positioned at said rear end of said cowling.

16. The outboard motor in accordance with claim 14, wherein said at least one intake port is positioned in a side of said cowling between said front and rear ends.

17. The outboard motor in accordance with claim 14, wherein said cowling has a recessed area and a cowling cover, said cowling cover cooperating with said cowling to define an intake chamber and an exhaust chamber, said at least one intake port positioned in said cowling cover and said first flow path leading to said intake chamber, said at least one exhaust port positioned in said cowling cover and said second flow path leading to said exhaust chamber.

* * * * *